United States Patent [19]

Philippar

[11] 4,047,298

[45] Sept. 13, 1977

[54] COMBINATION SHEATH AND RIGID HANDLE FOR KNIFE BLADES AND THE LIKE

[76] Inventor: Donald T. Philippar, Box 535, Sturgis, S. Dak. 57785

[21] Appl. No.: 701,691

[22] Filed: July 1, 1976

[51] Int. Cl.[2] ..... B26B 29/02

[52] U.S. Cl. ..... 30/153

[58] Field of Search ..... 30/153, 255

[56] References Cited

U.S. PATENT DOCUMENTS

| | | | |
|---|---|---|---|
| 229,706 | 7/1880 | Jansen | 30/153 |
| 1,665,955 | 4/1928 | Gatewood | 30/153 |
| 2,570,412 | 10/1951 | Vogel | 30/153 X |

*Primary Examiner*—Jimmy C. Peters

*Attorney, Agent, or Firm*—Williamson, Bains & Moore

[57] ABSTRACT

An improved and simplified combination sheath and rigid handle for small, elongate tools such as knife blades, saws, small chisels and the like is disclosed herein. The structure of the invention is combined with a tool such as a knife blade having a butt end which is provided with a pair of side-by-side hinge elements having axes which are disposed transversely of the longitudinal center line of the knife blade or other tool. Swingably connected to such hinge elements are a pair of cooperating sheaths and handle members such as elongate bars or plates of somewhat greater length than the knife blade or tool, and of width greater than the width of the tool for protecting the same in one of the operative positions of the device. These bar or plate members, near the free ends thereof, when swung rearwardly in opposing relation to form a handle, have interlocking elements which prevent lateral or other shifting of the two plates when positioned in opposing relation to form a handle and rigidify the combination tool. To protect the tool or user when not in use, the bar or plate elements are swung reversely forward in opposing relation, forming an enclosure covering the sides and edges of the knife blade or the like. A retaining means is also provided for holding the free ends of the two bars or plates in opposed relation in both the positions of a sheath and of a rigid handle.

4 Claims, 7 Drawing Figures

COMBINATION SHEATH AND RIGID HANDLE FOR KNIFE BLADES AND THE LIKE

This invention is an improvement on the structure disclosed in my U.S. Pat. No. 2,820,291, issued 1-21-58.

BACKGROUND OF THE INVENTION

Prior art, including patents and publications known to applicant and his attorneys is quite remote from the construction of my improved device with the exception of my prior U.S. Pat. No. 2,820,291. The structure of my prior patent provides a pair of elongate sheath and handle plates hinged along corresponding ends to hinge means provided at the butt of the knife or other analogous tool. The hinge plates could be swung rearwardly away from the butt end of the knife blade into opposed relation with the free ends thereof in close relation to, in combination, constitute a handle. However, a detachable cap-retaining member was required which could be readily lost unless connected by a chain with one of the plate members. This retainer, in the form of a cap however, could not prevent lateral shifting and some endwise displacement of the two sheath members. A further requirement of my said patented structure was a T-shaped pin oscillatable in the closed end of the cap member for inter-engagement with means on the sheath to positively connect the cap. The patented structure was feasible and was put in commercial use, but has definite disadvantages. Some difficulty was always involved in properly oscillating the T-head member for connection with the ends of the two sheath members. The cap member itself was sometimes hard to slide in place and was easily lost.

It is a main object of my present invention to overcome the foregoing disadvantages and provide a very inexpensive combination of elements which positively rigidifies the two hinged handle and sheath plates to prevent longitudinal or lateral shifting of the same when the plates are positioned to constitute a handle for the knife blade or other tool.

A further object is the provision of an improved structure which may be manufactured at very low cost and without expensive jigs, tooling and other capital expense for commercial manufacture.

Still a further object is the provision in one form of the device of a saddle element which may be detachably secured to conventional knife blades readily purchasable on the open market, and which provides positive retaining means for the saddle to the butt end of the knife, together with the two essential hinge elements for connection with the swingable sheath plates or bars.

SYNOPSIS OF THE INVENTION

The essential components of my present invention comprise a knife or other elongate, rather thin tool, having a butt end provided with a pair of side-by-side hinge elements protruding rearwardly from the butt and having axes disposed transversely of the longitudinal center line of the knife or other tool. Cooperating hinge elements such as apertured hinge tongues formed at corresponding ends of a pair of opposing sheath plates are connected with the hinge elements of the butt by pintles or other hinge connection means. The elongate bars or plates of adequate length when hinged forwardly, cover the sides and extend beyond the edges of the knife or other tool member. The said bars or plates may be swung rearwardly into opposing relation and near their free and opposing ends, are provided with interlocking means such as a pin and aperture or socket to interlock the two elements when in closed position to form a rigid handle. This interlocking prevents lateral or longitudinal shifting of the bars or plates whereby rigidity for a handle member is assured. To retain the two opposing plates or bars in closed position to constitute in the handle, and also in forwardly swung, opposing relation to constitute a sheath for the blade, suitable means is applied such as a narrow loop member which may be hinged near the free end of one of the bar members and is of a dimension to surround and tightly embrace the corresponding free end of the opposing bar member.

DETAILED DESCRIPTION OF EMBODIMENTS OF THE INVENTION

Three embodiments of the invention are illustrated in the accompanying drawings wherein similar reference numerals or letters refer to similar parts throughout the several views in common, and wherein, FIG. 1 is a top or edge elevation showing the parts interconnected for operation of the hand tool involved, which is in the form of a knife;

Referring now to the embodiment of the invention as shown in FIGS. 1 through 6 of the drawings, the hand tool involved comprises a substantially conventional knife blade indicated as an entirety bythe letter B, having a sharpened cutting edge 5 and a thickened butt portion 6 of a generally rectangular configuration. The butt portion, as shown, has a pair of centrally disposed, integrally formed hinge elements in the form of circular loops *6a*, (see particularly FIG. 5) which are arranged in side-by-side relation and have hinged axes extending transversely of the center line of blade B.

A pair of bi-functional elongate bars or plates identified as entireties C and D are hingedly connected at corresponding ends with the respective hinge elements *6a* forming part of the butt portion of the knife B. The members C and D are of generally elongate, rectangular shape and of a length longer than the knife B, and have transversely apertured hinge tongues C-1 and D-1 respectively, to closely surround hinge elements *6a* of the knife butt. A rigid hinge pintle or pin 7 for each of the hinge connections desired is driven through the respective hinge connections and completes the hinge structures for the dual function handle and sheath bars C and D. With such hinge connection the multi-functional bars or plates C and D are free to swing forwardly as shown in FIG. 3, to cover and protect a knife or other tool or may be swung rearwardly as shown in FIG. 2, to a position to constitute a handle for the hand tool.

Figure 1:
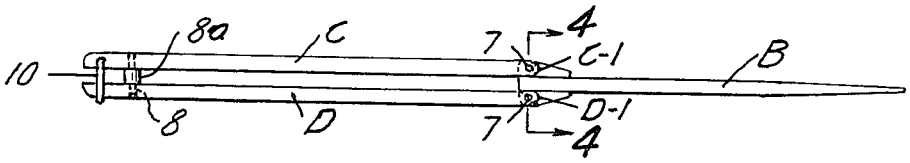
Figure 2:
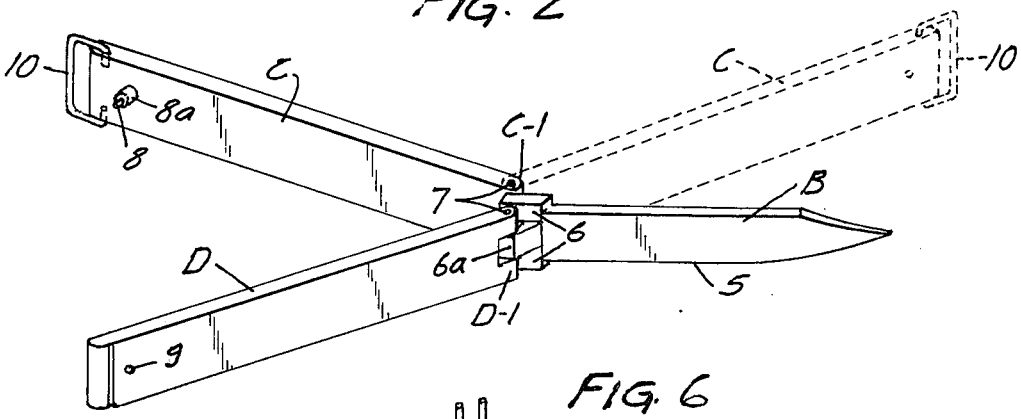
FIG. 2 is a perspective view illustrating the tool with the swingable handle and sheath bars in position prior to interlocking of the same to form a rigid handle for the knife.

As shown in FIG. 2 when the multi-functional bars or plates C and D are swung together behind the tool or knife blade B, means are provided for positive interlocking of the two plate elements C and D to prevent lateral or longitudinal shifting of the members when the tool is operatively employed for use. To this end, as shown in FIG. 2 and other figures of the drawings, a locking pin 8 is attached near the free end of the bar C for seating and interlocking relation with an aperture or socket 9 near the outer end of the second bar member D. Thus, when the two bar or plate members C and D are swung together in the position shown in FIG. 2, the parts will be interlocked to prevent lateral or longitudinal shifting movements of the two members which then constitute the operative handle for the hand tool. Interlocking pin 8 is preferably provided with an enlargement 8*a* disposed inwardly thereof for spacing apart the plate members C and D when they are interlocked to form a handle.

To positively retain the bar or plate parts C and D in operative relation for use of the knife or other tool, means are provided such as the swingable keeper loop member 10 which has ends 10*a* pivoted in suitable apertures provided by the bar C. The loop member, when the device is employed for operative use of the knife B, or in the protective and sheathing operation of the unit, is swung around the extremity portion of the opposing bar D, as clearly shown in FIGS. 1 and 3 of the drawings.

Figure 3:
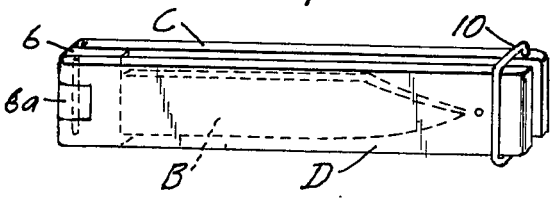
FIG. 3 is a perspective view showing the sheath plates in interlocked, protective position for shielding the knife within.
Figure 4:
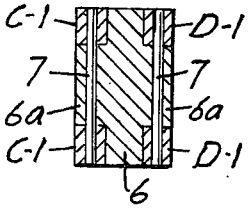
FIG. 4 is a cross section taken on the line 4--4 of FIG. 1.

It will be understood that there is sufficient resiliency in the bar members C and D so that the keeper loop 10 will always be under tension when applied either in the handle-making position or in the shielding position as shown in FIG. 3.

Figure 6:
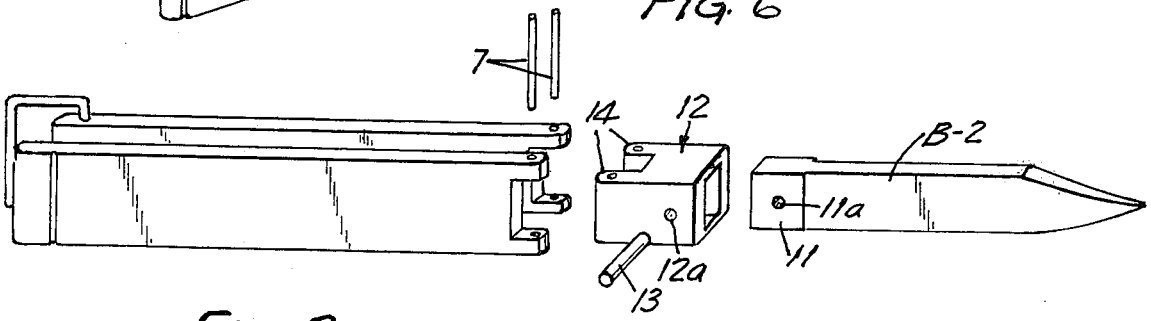
FIG. 6 is a perspective view showing an alternative saddle member which may be readily attached to conventional knife blades for supplying the essential hinge elements for the combination handle and sheath plates.

In FIG. 6 a variation or alternate construction for providing hinge elements at the butt of the knife blade or other tool, is illustrated. Here, a conventionally manufactured knife blade B-2 is shown having a conventional, somewhat enlarged rectangular butt 11 provided with a transverse aperture 11*a* for receiving a pin. A specially formed saddle member in the form of a cap 12 for closely fitting the butt 11 of the knife is provided having a closed end which will substantially abut the flat extremity of knife butt 11 with opposing side walls 12*a* which overlap the side portions of butt 11 and which have aligned apertures 12 for receiving an interlocking pin 13 which passes through the aperture 11*a* in the knife butt. The ends of the pin may be swedged after connection of the parts with the cap and knife butt and the saddle member will not swing because of close fitting of the outer wall and top and bottom walls 12*c* of the cap. Integrally formed with the cap member as described are a pair of centrally disposed hinge loops 14 which may be bent or cast from suitable material and are positioned as shown in FIG. 6 for side-by-side arrangement with spaced hinge pintle-receiving tubes 14*a*. The hinge loops are spaced apart and are equivalent to the hinge elements 6*a* provided by the form of the invention illustrated in FIGS. 1 to 5 of the drawings and will cooperate with the hinge tongues C-1 and D-1 of the combination handle and sheath plates C and D.

Figure 7:
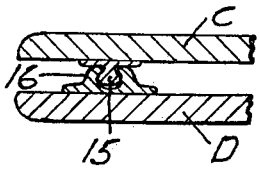
FIG. 7 is a fragmentary perspective view showing the blade members partially swung apart as in FIG. 2 but illustrating an alternative heavy snap-button connection for rigidifying the handle plates.
Figure 5:
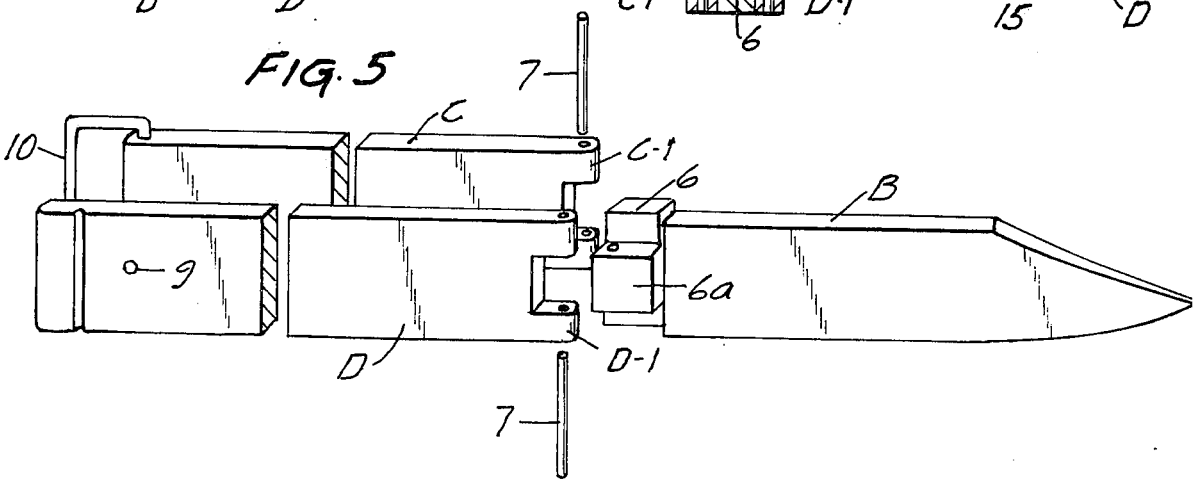
FIG. 5 is a detail perspective view on a larger scale showing the butt portion of a knife blade with integrally formed hinge loop elements disposed side-by-side and having their axes disposed transversely to the longitudinal center line of the blade.

In FIG. 7 of the drawings a fragmental perspective view illustrates a modification of the locking pin and socket aperture 9 of the form of the invention first described. This structure of FIG. 7 is recommended mostly for simple short knives and other tools where dangerous cutting edges are not involved. Here, a sturdy snap botton structure is substituted for connecting the outer ends of the two handle plates C and D to rigidify the handle and prevent wearing or longitudinal shifting of the two handle members. The male member 15 of the cooperating snap fastener is welded at its base or otherwise secured near the free end of the sheath plate C while the female member 16 is correspondingly affixed to the opposing side and for alignment with the male member 15. In this construction a keeper member 10 is not required but may, if desired, be also utilized and if utilized will suffice to retain the plates C and D at their outer ends when swung forwardly to protect the knife blade. If keeper members 10 are not employed then a second pair of snap elements are required on the opposite side and near the ends of plates C and D.

In all forms of the invention described, it will be noted that the simplified interconnections between the combination handle and sheath plates precisely position the plates and rigidifies the same when swung rearwardly in opposed handle-constituting position. No lateral or longitudinal shifting of the plates C and D is possible when the device is positioned for manual use.

It will further be seen that no loose retaining elements are necessary, such as required in the structure of my issued patent.

The cost of manufacture and assembly of my new improved device is substantially less than that of my original invention.

While the drawings herein do not illustrate a continuous double bladed knife member or tool, it will be apparent that my hinged combination handle and sheath is equally applicable to the double ended tool element disclosed in my U.S. Pat. No. 2,820,291.

I claim:

1. In combination with a knife blade or the like having relatively broad sides and an attachment butt with substantially parallel, broad attachment surfaces, a combination handle and protective sheath for said knife blade comprising a pair of elongate, substantially flat members having widths somewhat greater than the maximum width of said knife blade and hingedly attached at corresponding ends to the respective surfaces of the butt of said blade and thereby spacing said elongate members apart a distance slightly greater than the thickness of said knife blade, the attachment surfaces of said butt having outstanding hinge elements affixed thereto with the axes of said elements being disposed transversely of said butt surfaces, the hinged attachment ends of said substantially flat members having hinge elements formed therein for complemental positioning respectively with the outstanding hinge elements of said blade butt to operatively and hingedly interconnect said butt and members for swinging of said members forwardly in opposition to the sides of said knife blade and rearwardly of said butt to opposed position jointly constituting a handle for said blade, one of said members adjacent its unhinged end carrying a pin projecting in opposition to the other elongate member when said members are swung fully rearwardly to jointly form said handle, and said opposing elongate member having a recess near its unhinged end for receiving and interlocking with said pin.

2. The structure and combination set forth in claim 1 wherein said elongate handle-forming members constitute simply a pair of substantially rigid, elongate, generally rectangular plates, and wherein the complementary hinge elements of said members are formed by appropriately notching the corresponding hinged ends of said plates and transversely boring such notched ends for reception of hinge pintles.

3. The structure and combination set forth in claim 1 and an embracing member connected with one of the free ends of one of said elongate members for embracing the free ends of both members when said members are swung rearwardly into handle-forming position and also when said elongate members are swung forwardly to constitute a sheath for the knife blade.

4. The structure and combination set forth in claim 1 wherein said pair of hinge-forming elements are secured to said butt end by a narrow cap member rigidly carrying said elements to substantially cover said butt end and detachably connected therewith.

* * * * *